US010275963B1

(12) United States Patent
Shen

(10) Patent No.: US 10,275,963 B1
(45) Date of Patent: Apr. 30, 2019

(54) ANTI-THEFT CONTROL METHOD AND ANTI-THEFT CONTROL SYSTEM

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 15/901,943

(22) Filed: Feb. 22, 2018

(30) Foreign Application Priority Data

Jan. 31, 2018 (TW) ..... 107103394

(51) Int. Cl.
*G07C 9/00* (2006.01)
*G08B 13/24* (2006.01)

(52) U.S. Cl.
CPC ..... *G07C 9/00309* (2013.01); *G07C 9/00563* (2013.01); *G08B 13/2402* (2013.01); *G07C 2009/0042* (2013.01); *G07C 2009/00769* (2013.01)

(58) Field of Classification Search
CPC ..... G07C 2009/00769; G07C 9/00174; G07C 9/00563; G08B 13/2402
See application file for complete search history.

(56) References Cited

U.S. PATENT DOCUMENTS 9,619,954 B2 * 4/2017 Allibhoy ..... G07C 9/00309
2013/0342314 A1 * 12/2013 Chen ..... G07C 9/00309 340/5.65
2014/0247113 A1 * 9/2014 Paquin ..... G07C 9/00007 340/5.65
2015/0206365 A1 * 7/2015 Wu ..... H04B 5/0031 340/5.61

* cited by examiner

*Primary Examiner* — Omeed Alizada
(74) *Attorney, Agent, or Firm* — Alan D. Kamrath; Kamrath IP Lawfirm, P.A.

(57) ABSTRACT

An anti-theft control system includes an electronic key and anti-theft equipment. The electronic key includes a display. The electronic key carries out a first identification step to decide the display whether to show an authentication information related to a user of the electronic key. An image pick-up device of the anti-theft equipment reads the authentication information on the display and determines whether to release the anti-theft state. If the electronic key is lost, a person picking up the electronic key cannot pass the verification of the first identification step and, thus, cannot use the electronic key to control the anti-theft equipment. An anti-theft control method can be carried out using the anti-theft control system.

30 Claims, 8 Drawing Sheets

ANTI-THEFT CONTROL METHOD AND ANTI-THEFT CONTROL SYSTEM

BACKGROUND OF THE INVENTION

The present invention relates to an anti-theft control method and an anti-theft control system and, more particularly, to an anti-theft control system that determines whether to release the anti-theft state after electronic identification as well as an anti-theft control method using the system.

With the progress of technologies, conventional mechanical locks have been evolved from mechanical unlocking into combined mechanical/electronic unlocking provisions (the so-called electronic locks). A type of electronic lock is capable of reading an identification information stored in a door access card by RFID technology to judge whether to unlock. The advantage of the door access card is thin and light, because no batteries are required. Another type of electronic lock uses a remote control technique to unlock. Specifically, a user operates a remote controller to release the anti-theft state (including unlocking).

A common problem of the door access card and releasing the anti-theft state by remote control is that when the door access card or the remote controller is lost, a person picking up the door access card or the remote controller can use the information stored in the door access card or the remote controller, resulting in safety risks.

BRIEF SUMMARY OF THE INVENTION

In a first aspect, an anti-theft control method includes:

a registration step including storing an identification comparison information and an authentication information related to a holder of an electronic key in a memory of the electronic key, setting the identification comparison information and the authentication information as a set, and storing an anti-theft state releasing identification information correlated to the authentication information in a main memory of anti-theft equipment;

an anti-theft state activation step including setting a lock device of the anti-theft equipment to a locking state, wherein a display of the electronic key does not show the authentication information when in the anti-theft state;

a first identification step including inputting an instant identification information when it is intended to release the anti-theft state, wherein the instant identification information is compared with the identification comparison information, wherein the anti-theft state is released and the display shows the authentication information when the instant identification information matches with the identification comparison information, and wherein the anti-theft state is retained and the display does not show the authentication information when the instant identification information does not match with the identification comparison information; and a second identification step including reading the authentication information on the display with an image pick-up device of the anti-theft equipment and comparing the authentication information read by the image pick-up device with the anti-theft state releasing identification information, wherein the anti-theft state is not released and the lock device remains in the locking state when the authentication information read by the image pick-up device does not match with the anti-theft state releasing identification information, and wherein the anti-theft state is released and the lock device is set to an unlocking state when the authentication information read by the image pick-up device matches with the anti-theft state releasing identification information.

In an example, the registration step further includes storing at least one personalized setting in the main memory. The at least one personalized set value is correlated to a controllable device and the authentication information. The controllable device is adapted to be operated by the holder of the electronic key. When the anti-theft state is being released, the controllable device is set by the at least one personalized setting correlated to the authentication information read by the anti-theft equipment.

In an example, the anti-theft control method further includes a manual adjusting step including manually adjusting at least one operational parameter of the controllable device after the controllable device is set by the at least one personalized setting. The at least one operational parameter is different from the at least one personalized setting.

In an example, the anti-theft control method further includes a stop or hibernation step after the controllable device is set by the at least one personalized setting. The stop or hibernation step includes connecting the electronic key with a reader and outputting a stop signal or a hibernation signal from the anti-theft equipment to the controllable device to stop or hibernate the controllable device.

In an example, each of the identification comparison information and the authentication information includes at least one of a vocal pattern, a fingerprint, a pin number, a figure, and a biological feature of an iris, a finger vein, or a face.

In another example, the identification comparison information and the authentication information are identical or different biological features.

In an example, the anti-theft control method further includes a reset step including resetting the anti-theft state after the lock device has been set to the unlocking state and operated and/or manually setting the anti-theft equipment to the anti-theft state.

In an example, in the first identification step the instant identification information is inputted through an input device of the electronic key, and a microprocessor of the electronic key identifies whether the instant identification information matches with the identification comparison information.

In an example, the registration step further includes inputting a management authorization information into a management device to obtain a management authority and connecting the management device with one of the electronic key and the anti-theft equipment that has not been set. When the management device is connected to the electronic key, the identification comparison information and the authentication information are inputted through a management input device of the management device and are stored in the memory of the electronic key. When the management device is connected to the anti-theft equipment, the anti-theft state releasing identification information is inputted through the management input device and is stored in the main memory of the anti-theft equipment.

In an example, before activating the anti-theft state, the anti-theft control method further includes electronically connecting the electronic key with the anti-theft equipment and supplying electricity from the anti-theft equipment to the electronic key for operation. When the instant identification information matches with the identification comparison information in the first identification step, the anti-theft state is released, and the display uses the electricity supplied by the anti-theft device to show the authentication information.

Furthermore, the electronic key is disconnected from the anti-theft equipment after the second identification step.

In an example, in the first identification step the instant identification information is inputted through an input device of the electronic key using the electricity supplied by the anti-theft equipment.

In another example, in the first identification step the instant identification information is inputted through a main input device of the anti-theft equipment.

In an example, in the registration step the identification comparison information and the authentication information are inputted through a main input device of the anti-theft equipment while the electronic key is in electrical connection with the anti-theft equipment.

In an example, the registration step further includes storing at least one personalized setting in the main memory. The at least one personalized set value is correlated to a controllable device and the authentication information. The controllable is adapted to be operated by the holder of the electronic key. When the anti-theft state is being released, the controllable device is set by the at least one personalized setting correlated to the authentication information read by the anti-theft equipment.

In a second aspect, an anti-theft control method includes:

storing an identification comparison information and an authentication information in an electronic key;

storing an anti-theft state releasing identification information in anti-theft equipment, wherein the electronic key compares an inputted instant identification information with the identification comparison information, wherein a display of the electronic key shows the authentication information when the instant identification information matches with the identification comparison information; and reading the authentication information on the display with the anti-theft equipment and comparing the authentication information with the anti-theft state releasing identification information, wherein the anti-theft state is released and the lock device is set to an unlocking state when the authentication information read by the anti-theft equipment matches with the anti-theft state releasing identification information, and wherein the anti-theft state is not released and the lock device remains in the locking state when the authentication information read by the anti-theft equipment does not match with the anti-theft state releasing identification information.

In a third aspect, an anti-theft control system includes an electronic key and anti-theft equipment. The electronic key includes a microprocessor and a memory electrically connected to the microprocessor. An identification comparison information and an authentication information are stored in the memory. A display is electrically connected to the microprocessor and is configured to display the authentication information. The electronic key is configured to be inputted with an instant identification information that is temporarily stored. The display shows the authentication information when the instant identification information matches with the identification comparison information. The display does not show the authentication information when the instant identification information does not match with the identification comparison information. The anti-theft equipment includes a microprocessing unit and a lock device electrically connected to the microprocessing unit. The microprocessing unit is configured to set the lock device to a locking state or an unlocking state. A main memory is electrically connected to the microprocessing unit. An anti-theft state releasing identification information is stored in the main memory. An image pick-up device is electrically connected to the microprocessing unit. The image pick-up device is configured to read the authentication information displayed on the display. The lock device is set to the unlocking state when the authentication information read by the image pick-up device matches with the anti-theft state releasing identification information. The lock device is set to the locking state when the authentication information read by the image pick-up device does not match with the anti-theft state releasing identification information.

In an example, the anti-theft control system further includes a controllable device electrically connected to the microprocessing unit. A personalized setting is stored in the main memory and is correlated to the controllable device. When the lock device is set to the unlocking state, the microprocessing unit uses the personalized setting to set the controllable device.

In an example, the anti-theft control system further includes a reader electrically connected to the microprocessing unit of the anti-theft equipment. The reader is configured to read the electronic key. The microprocessing unit is configured to stop or hibernate the controllable device through a setting of stop of hibernation when the reader 38 is reading the electronic key.

In an example, the electronic key further includes a first electrode electrically connected to the microprocessor. The anti-theft equipment further includes a power supply module electrically connected to the microprocessing unit and a second electrode electrically connected to the microprocessing unit. When the first electrode is not in electrical connection with the second electrode, the display does not operate. When the first electrode is in electrical connection with the second electrode, the display is capable of showing the authentication information.

In an example, the anti-theft equipment further includes a main input device electrically connected to the microprocessing unit. When the first electrode is in electrical connection with the second electrode, the instant identification information is inputted through the main input device.

In an example, the image pick-up device and the second electrode together form a card reading device. The electronic key is detachably coupled to the card reading device. When the electronic key is coupled with the card reading device, the second electrode is in electrical connection with the first electrode, and the display is located at an inner side of the card reading device and is aligned with the image pick-up device.

In an example, the electronic key further includes a power supply unit electrically connected to the microprocessor. The power supply unit is configured to supply electricity to the electronic key for operation.

In an example, the electronic key further includes an input device electrically connected to the microprocessor, and the instant identification information is inputted through the input device.

In an example, the anti-theft control system further includes a management device. The management device includes a processor, a first connecting module electrically connected to the processor, and a management input device electrically connected to the processor. The electronic key further includes a near field communication module configured to be electrically connected to the microprocessor. When the near field communication module is electrically connected to the microprocessor, the management input device is configured to permit the identification comparison information and the authentication information to be inputted and stored in the memory of the electronic key.

In an example, the anti-theft control system further includes a management device. The management device includes a processor, an electrical connector electrically connected to the processor, and a management input device electrically connected to the processor. When the first electrode is electrically connected to the electrical connector, the management input device permits the identification comparison information and the authentication information to be inputted and stored in the memory of the electronic key.

In an example, the display of the electronic key is formed by an electronic paper.

The present invention will become clearer in light of the following detailed description of illustrative embodiments of this invention described in connection with the drawings.

Figure 1:
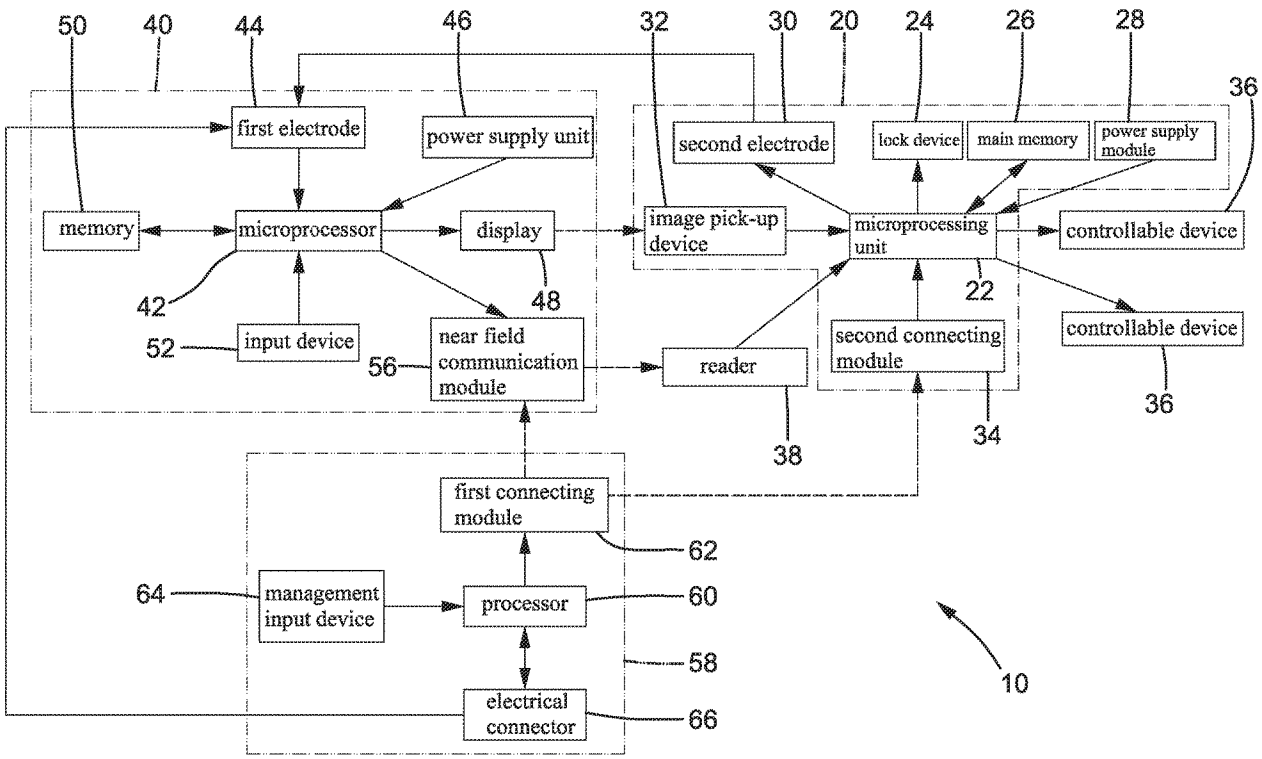
FIG. 1 is a block diagram of an anti-theft control system of a first embodiment according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

With reference to FIGS. 1-5, an anti-theft control system 10 of a first embodiment according to the present invention includes an electronic key 40 having a microprocessor 42. The electronic key 40 further includes a first electrode 44, a power supply unit 46, a display 48, a memory 50, an input device 52, and a near filed communication module 56. The first electrode 44, the power supply unit 46, the display 48, the memory 50, the input device 52, and the near filed communication module 56 are electrically connected to the microprocessor 42. At least one identification comparison information and at least one authentication information can be stored in the memory 50. The input device 52 permits a holder of the electronic key 40 to input an instant identification information that is temporarily stored. The display 48 is configured to display the authentication information. The display 48 of the electronic key 40 can be a liquid crystal screen or an electronic paper. The power supply unit 46 supplies electricity to the electronic key 40 for operation. The electronic key 40 can be of a card type or a remote controller. Alternatively, the electronic key 40 can be a smart phone.

Each of the at least one identification comparison information and the at least one authentication information includes at least one of a vocal pattern, a fingerprint, a biological feature (of an iris, a finger vein, or a face), a pin number, and a figure. The identification comparison information and the authentication information are identical or different biological features. In a case that each of the identification comparison information and the authentication information is a biological feature, the input device 52 can be a biological feature pick-up device, such as a fingerprint pick-up device, a microphone, an iris pick-up device, a finger vein pick-up device, or a mini camera. In another case that each of the at least one identification comparison information and the at least one authentication information is a pin number, the input device 52 can be a keypad or a touch screen. In a further case that each of the at least one identification comparison information and the at least one authentication information is a figure, the input device 52 can be a touch screen or a touch panel.

With reference to FIG. 1, the anti-theft control system 10 further includes a management device 58. The management device 58 includes a processor 60, a first connecting module 62 electrically connected to the processor 60, and a management input device 64 electrically connected to the processor 60. The management device 58 can further include an electrical connector 66 electrically connected to the processor 60. The management input device 64 is correlated to the identification comparison information and the authentication information. In a case that the management device 58 is a smart phone, the management device 58 does not have to include the electrical connector 66. In this case, the smart phone and the electronic key 40 are connected via the near field communication module 56 and the first connecting module 62. In another case that the management device 58 is a computer, the management device 58 does not have to include the first connecting module 62. In this case, the computer can use a card reader as the electrical connector 66 to connect the first electrode 44 of the electronic key 40.

With reference to FIG. 1, the anti-theft control system 10 further includes anti-theft equipment 20. The anti-theft equipment 20 includes a microprocessing unit 22, a lock device 24, a main memory 26, a power supply module 28, a second electrode 30, an image pick-up device 32, and a second connecting module 34. The lock device 24, the main memory 26, the power supply module 28, the second electrode 30, the image pick-up device 32, and the second connecting module 34 are electrically connected to the microprocessing unit 22. At least one anti-theft state releasing identification information is stored in the main memory 26 and is of the same type as the at least one authentication information, such as a graphical vocal pattern. The image pick-up device 32 can be a mini camera to read the authentication information on the display 48. The power supply module 28 can be connected to the main power to supply electricity required for operation of the anti-theft equipment 20. The microprocessing unit 22 is configured to set the lock device 24 to a locking state correlated to the anti-theft state of the anti-theft equipment 20 or an unlocking state correlated to an anti-theft released state. Furthermore, the lock device 24 can be varied according to the environment. In an example shown in FIG. 3, the anti-theft equipment 20 is used in a room 72 to control access. The lock device 24 is mounted on a door 70 of the room 72. In another example shown in FIG. 5, the anti-theft equipment 20 is used on a vehicle 75. The lock device 24 is a lock mounted on a vehicle door 77 of the vehicle 75. The lock device 24 can be set to the locking device not permitting operation of the lock device 24 for the purposes of opening the door 70 or the vehicle door 77.

With reference to FIG. 1, the anti-theft control system 10 can further include a reader 38 and at least one controllable device 36. The at least one controllable device 36 can be a lamp, an air conditioner, audio equipment or a television in a case that the anti-theft equipment 20 is used in the room 72 (see FIG. 3). In another example that the anti-theft equipment 20 is used on the vehicle 75, the at least one controllable device 36 can be a seat, a steering wheel, car audio equipment, etc. The reader 38 can be connected to the near filed communication module 56 of the electronic key 40, and a stop or hibernation signal can be outputted through the microprocessing unit 22 to the at least one controllable device 36.

Figure 4:
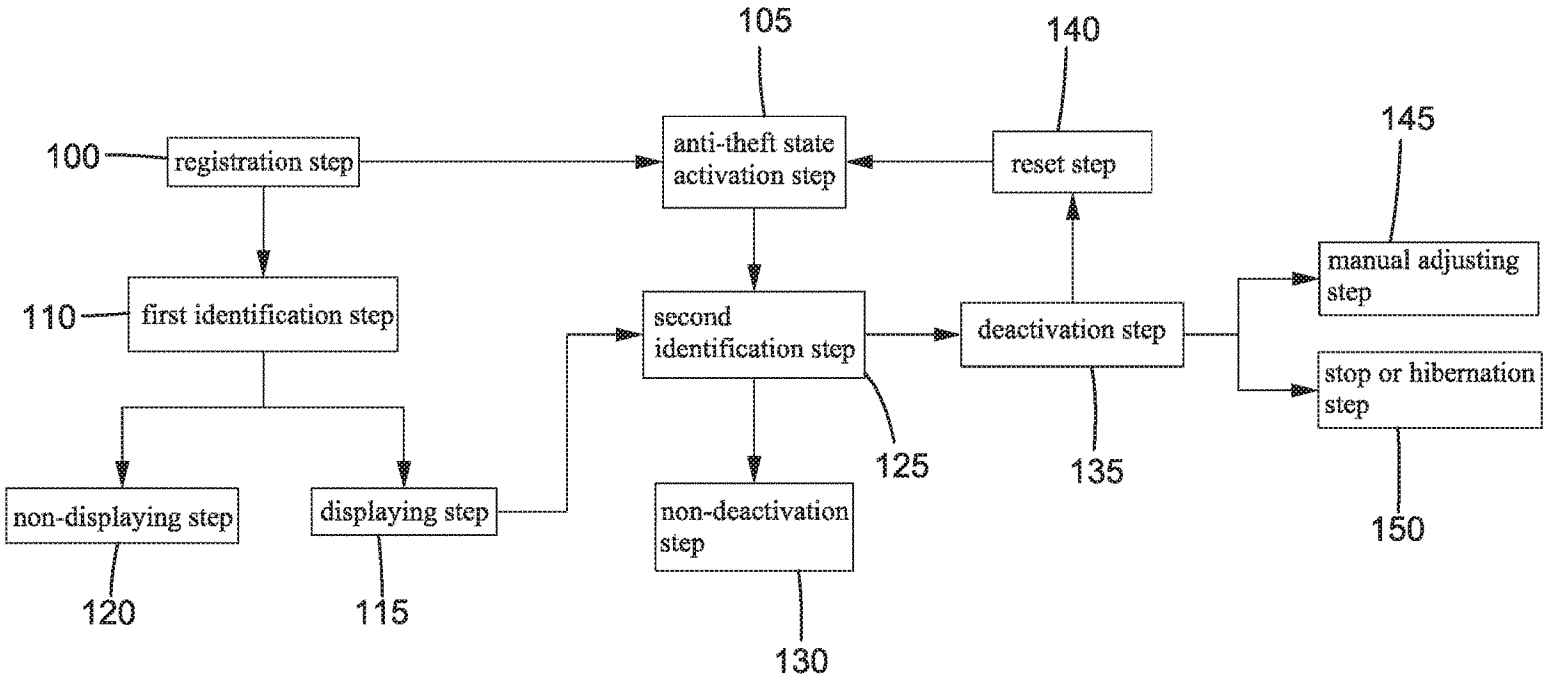
FIG. 4 is a schematic flowchart illustrating an anti-theft control method of the first embodiment according to the present invention.

With reference to FIG. 4, an anti-theft control method according to the present invention includes a registration step 100 including storing the identification comparison information and the authentication information correlated to a holder of the electronic key 40 in the memory 50 of the electronic key 40, setting the identification comparison information and the authentication information as a set, and storing an anti-theft state releasing identification information correlated to the authentication information in the main memory 26 of the anti-theft equipment 20.

The identification comparison information and the authentication information are inputted through the management device 58 into the electronic key 40. The management authority can be obtained through input of a management identification information. For example, login of a management system of the management device 58 requires a set of management identification information consisting of an account number and a pin number. After login of the management system, the management device 58 can be connected to the near field communication module 56 of the electronic key 40 via the first connecting module 60 or connected to the first electrode 44 of the electronic key 40 via the electrical connector 66 (and supplies the electricity required for operation). Furthermore, the management input device 64 permits input of at least one identification comparison information and at least one authentication information into the memory 50. An identification comparison information and an authentication information that are inputted at the same time are paired as a set correlated to a specific user (the owner of the electronic key 40). Many sets can be obtained after pairing.

Similarly, the management device 58 can use the first connecting module 62 to connect the second connecting module 34. The management input device 64 is used to input at least one anti-theft state releasing identification information (correlated to the at least one authentication information) into the main memory 26. Furthermore, at least one personalized setting is stored in the main memory 26 and is correlated to the corresponding authentication information. Thus, an identification comparison information matches with only one authentication information, and an authentication information matches with only one anti-theft state releasing identification information and only one personalized setting. Namely, an identification comparison information, an authentication information, an anti-theft state releasing identification information and a personalized setting are related to one user. Nevertheless, a single electronic key 40 can be inputted with a plurality of sets of informations, and the anti-theft equipment 20 permits input of a plurality of correlated anti-theft state releasing identification informations and a plurality of personalized settings. Thus, identification informations of different users can be inputted into a single electronic key 40, and the anti-theft control system 10 can identify the user. After logging out the management system 58, connection with the electronic key 40 and the anti-theft equipment 20 is not possible. Furthermore, the management system 58 can be a smart phone or a computer of a manager that manages the management system 58.

After storing at least one identification comparison information and at least one authentication information into the memory 50 of the electronic key 40 and storing at least one anti-theft state releasing identification information into the main memory 26 of the anti-theft equipment 20, an anti-theft state activation step 105 is carried out by the anti-theft equipment 20 and the electronic key 40. In the anti-theft state activation step 105 the microprocessing unit 22 of the anti-theft equipment 20 sets the lock device 24 to the locking state. The display 48 of the electronic key 40 does not show any authentication information when in the anti-theft state.

When it is desired to release the anti-theft state 20 by using the electronic key 40, a first identification step 110 is carried out. The first identification step 110 includes inputting an instant identification information (by using the input device 52) into the electronic key 40. The instant identification information is stored temporarily and is compared with the identification comparison information.

The anti-theft state is released and the display 48 shows a corresponding authentication information when the instant identification information matches with the identification comparison information (a displaying step 115). On the other hand, the anti-theft state is retained and the display 48 does not show any authentication information when the instant identification information does not match with the identification comparison information (a non-displaying step 120).

When the display 48 of the electronic key 40 shows an authentication information, a second identification step 125 is carried out. The second identification step 125 includes reading the authentication information on the display 48 with the image pick-up device 32 of the anti-theft equipment 20 and comparing the authentication information (read by the image pick-up device 32) with the anti-theft state releasing identification information by the microprocessing unit 22.

The anti-theft state is not released and the lock device 24 remains in the locking state when the authentication information read by the image pick-up device 32 does not match with the anti-theft state releasing identification information (i.e., a non-deactivation step 130 not releasing the anti-theft state). On the other hand, the anti-theft state is released and the lock device 24 is set to the unlocking state when the authentication information read by the image pick-up device 32 matches with the anti-theft state releasing identification information (a deactivation step 135 releasing the anti-theft state).

After the at least one controllable device 36 is set by the at least one personalized setting, a manual adjusting step 145 can still be carried out. The manual adjusting step 145 includes manually adjusting at least one operational parameter of the at least one controllable device 36. Furthermore, a stop or hibernation step 150 can be carried out after the at least one controllable device 36 is set by the at least one personalized setting. The stop or hibernation step 150 includes connecting the electronic key 40 with the reader 38 and outputting a stop signal or a hibernation signal from the anti-theft equipment 20 to the at least one controllable device 36 to stop or hibernate the at least one controllable device 36.

A reset step 140 can be carried out by resetting the anti-theft state after the lock device 24 has been set to the unlocking state and operated and/or manually setting the anti-theft equipment 20 to the anti-theft state. Thus, the anti-theft equipment 20 can be reset to the anti-theft state.

Figure 2:
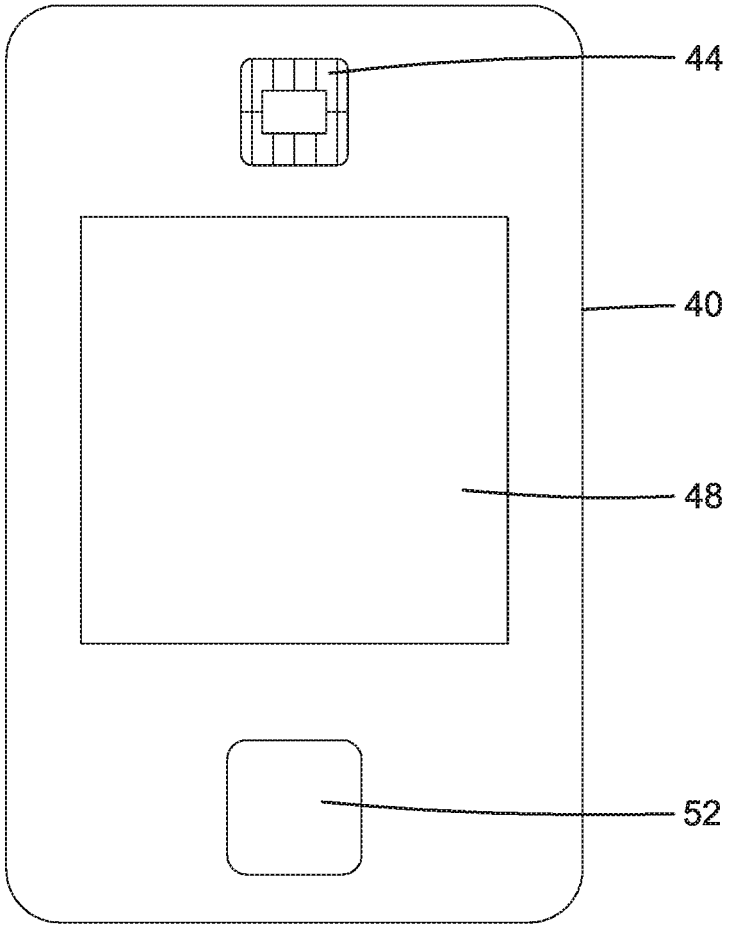
FIG. 2 is a side view of an electronic key of the anti-theft control system of the first embodiment according to the present invention.
Figure 3:
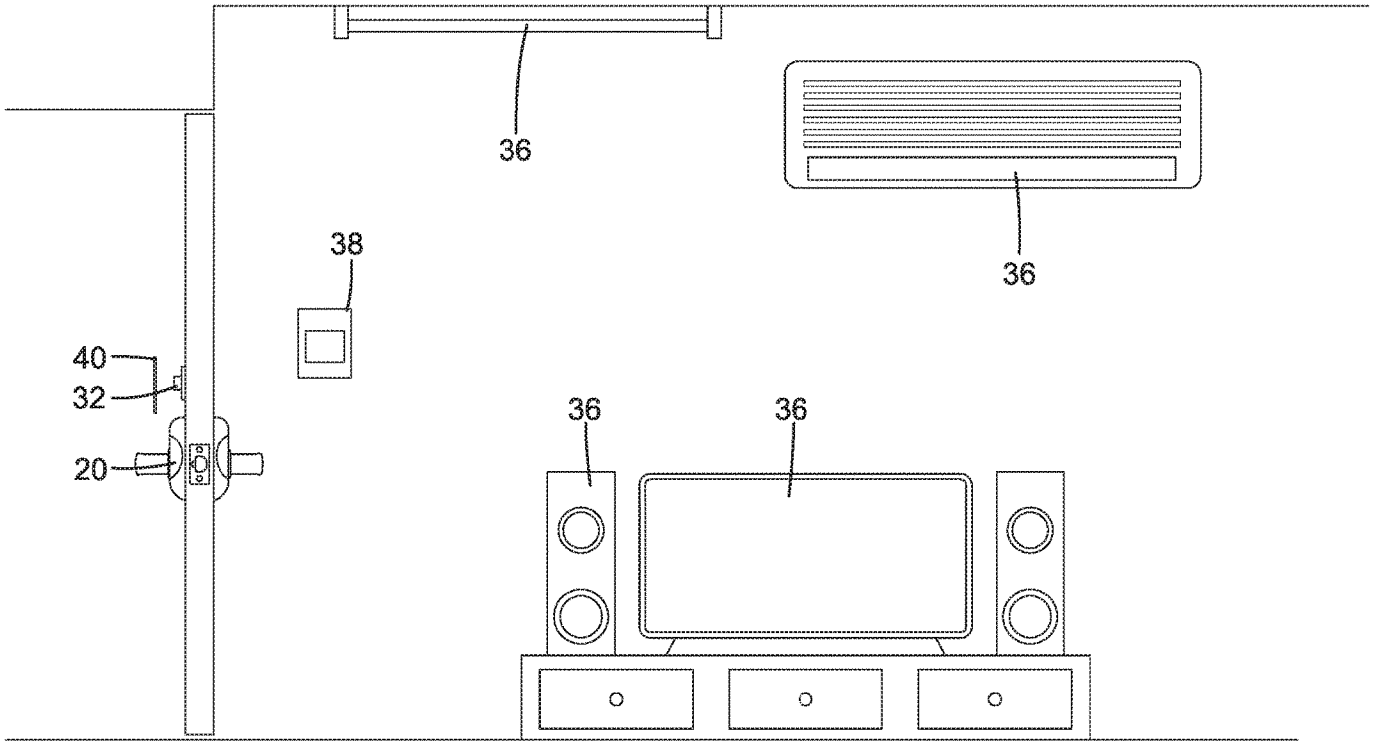
FIG. 3 is a schematic view illustrating use of the anti-theft control system of the first embodiment according to the present invention in a room.

The anti-theft control system 10 according to the present invention can be applied in various situations or conditions. With reference to FIGS. 2 and 3, for the sake of explanation, it will be assumed that the anti-theft control system 10 is used to control door access in an ordinary house. The lock device 24 is a door lock on a door 70. The image pick-up device 32 is mounted at an outer side of the door 70. The at least one controllable device 36 includes a lamp, an air conditioner, audio equipment, and a television. Each of the identification comparison information and the authentication information is the vocal pattern of the holder. Thus, the input device 52 of the electronic key 40 is a mini microphone. Furthermore, it is assumed that the electronic key 40 includes the power supply unit 46 to supply electricity, such that the anti-theft equipment 20 does not include the second electrode 30.

It is assumed that the electronic key 40 is set to be used by a first user and a second user. In this case, after the management device 58 uses the management identification information to obtain the management authority, the management device 58 is connected to the electronic key 40 via the electrical connector 66 (such as a card reader). Then, the first user speaks words (such as "please open the door") to the management input device 64, and the management device 58 converts the voice of the first user into a visual vocal pattern which is sent to the memory 50 and is stored. Furthermore, the vocal pattern can be set as at least one of the identification comparison information and the authentication information. Assume the identification comparison information is the first vocal pattern (of words such as "please open the door"), and the authentication information is the second vocal pattern (of words such as "it's me"), the identification comparison information (the first vocal pattern) and the authentication information (the second vocal pattern) are paired as a set correlated to the first user.

Similarly, after the first user has completed the registration, the second user speaks words (which can be the same or different from that of the first user) to the management input device 64, and the management device 58 converts the voice of the second user into a visual vocal pattern which is sent to the memory 50 and is stored. Furthermore, the vocal pattern can be set as at least one of the identification comparison information and the authentication information. Assume the identification comparison information is the third vocal pattern, and the authentication information is the fourth vocal pattern, the identification comparison information (the third vocal pattern) and the authentication information (the fourth vocal pattern) are paired as a set correlated to the second user.

After the first and second users have completed the registration, the first connecting module 62 of the management device 58 is connected to the second connecting module 34 of the anti-theft equipment 20. Furthermore, the first user speaks "it's me" to the management input device 64, and the management device 58 converts the voice of the first user into a visual vocal pattern stored in the main memory 26 of the anti-theft equipment 20 as an anti-theft state release identification information. In this state, the vocal pattern representing the anti-theft state release identification information of the first user will be the same as the vocal pattern representing the authentication information of the first user. Furthermore, at the same time of registration of the anti-theft state release identification information, the personalized setting of the lamp, the air conditioner, the audio equipment, and the television can be set, such as the brightness and color of the lamp, operation of the air conditioner (including the temperature and the wind output), whether turning on the audio equipment (including the volume), whether turning on the television (including the channel), etc. An anti-theft state release identification information is related to a personalized setting. Likewise, the anti-theft state release identification information (matched with the authentication information of the second user) and the personalized setting correlated to the second user (identical to or different from that of the first user) can be stored in the main memory 26 of the anti-theft equipment 20.

After the management device 58 is disconnected from the electronic key 40, the electronic key 40 enters the anti-theft state. After management device 58 is disconnected from the anti-theft equipment 20, the anti-theft equipment 20 enters the anti-theft state (the anti-theft state activation step 105). Thus, the display 48 of the electronic key 40 will not show the authentication information of the first or second user. The lock device 24 is set to the locking state, and the door 70 cannot be opened. Furthermore, it will be assumed that the lamp, the air conditioner, the audio equipment, and the television in the room 72 are turned off or in a hibernation state (the anti-theft state activation step 105).

In a case that the first user intends to use the electronic key 40 to open the door 70, the first user speaks "please open the door" to the input device 52 (a mini microphone), and the input device 52 picks up the voice of the first user and converts it into an instant identification information. Furthermore, the microprocessor 42 identifies that the instant identification information matches with the authentication information of the first user that has been registered (but does not match with the authentication information of the second user). The display 48 shows the authentication information of the first user but does not show the authentication information of the second user.

Then, the electronic key 40 is placed near the image pick-up device 32 of the anti-theft equipment 20. The image pick-up device 32 reads the authentication information of the first user on the display 48, and the authentication information of the first user read by the image pick-up device 32 is compared with the two anti-theft state release identification informations stored in the main memory 26 (the second identification step 125). Since the authentication information of the first user read by the image pick-up device 32 matches with the anti-theft state release identification information of the first user, the microprocessing unit 22 sets the lock device 24 to the unlocking state. Thus, the anti-theft state of the anti-theft equipment 20 is released. The first user can operate the lock device 24 on the door 70 to open the door 70 and can enter the room 72. Furthermore, at the same time of releasing the anti-theft state of the anti-theft equipment 20, the microprocessor 22 uses the personalized setting correlated to the authentication information (or the anti-theft state release identification information) of the first user to set the lamp, the air conditioner, the audio equipment, and the television in the room 72 (the anti-theft state deactivation step 135).

After releasing the anti-theft state of the anti-theft equipment 20, the electronic key 40 reenters the anti-theft state, such that the display 48 does not show any authentication information. After the first user has opened the door 70 and entered the room 72, the door 70 is closed again, and the anti-theft equipment 20 returns to the anti-theft state (the reset step 140). Thus, the door 70 cannot be opened from the outside but can be opened from the inside.

In a case that the second user intends to use the electronic key 40 to open the door 70, the first identification step 110 is carried out, such that the instant identification information inputted by the second user makes the display 48 show the authentication information of the second user. Furthermore, after it is identified that the authentication information of the second user matches with the matches with the anti-theft state release identification information of the second user, the microprocessing unit 22 sets the lock device 24 to the unlocking state, and the anti-theft state of the anti-theft equipment 20 is released. Furthermore, the personalized setting of the second user is used to set the lamp, the air conditioner, the audio equipment, and the television in the room 72.

Furthermore, the lamp, the air conditioner, the audio equipment, the television in the room 72 can be manually adjusted (the manual adjusting step 145) to set at least one operational parameter of the lamp, the air conditioner, the audio equipment, and the television in the room 72 to be different from the personalized setting. If the first or second user leaves the room 72, all of the lamp, the air conditioner, the audio equipment, and the television in the room 72 can be turned off or hibernate by placing the electronic key 40 near the reader 38 in the room 72, which causes connection of the near field communication module 56 of the electronic key 40 and the reader 38. Thus, the anti-theft equipment 20 will output a stop signal or a hibernate signal to turn off or hibernate all of the lamp, the air conditioner, the audio equipment, and the television in the room 72.

If the electronic key 40 is lost and picked up by a person that subsequently uses the input device 52 of the electronic key 40 to input an instant identification information (the first identification step 110), even if the person speaks the same word (such as "please open the door") as the first or second user, the vocal pattern converted from the instant identification information of the person is different from the vocal patterns of the first and second users (because the tone is different), such that the display 48 will not show the authentication informations of the first and second users. As a result, the person cannot use the electronic key 40 to release the anti-theft state of the anti-theft equipment 20.

Figure 5:
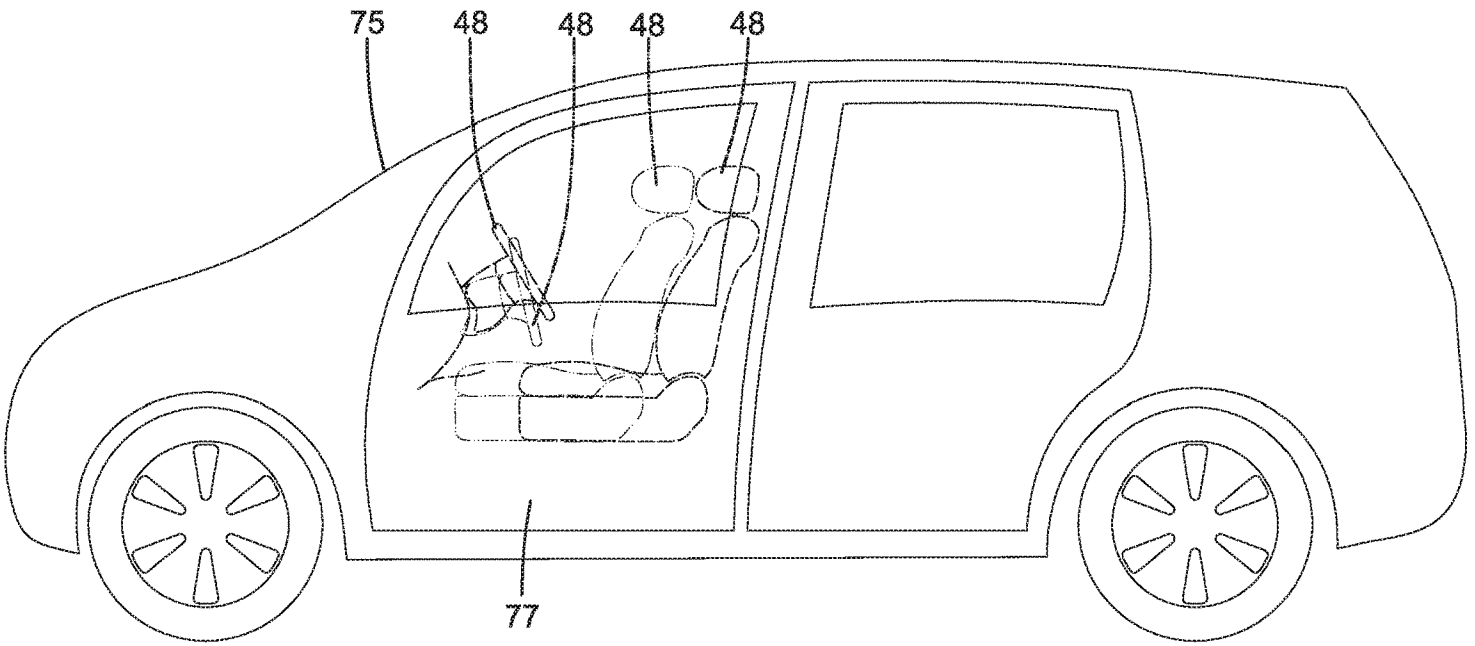
FIG. 5 is a schematic view illustrating use of the anti-theft control system of the first embodiment according to the present invention in a vehicle.

In addition to the use in the room 72, the anti-theft control system 10 and the anti-theft control method according to the present invention can be used in other conditions and places, such as access control of a vehicle. With reference to FIG. 5, the lock device 24 is a lock mounted to a door 77 of a vehicle 75. In comparison with the access control of the room 72, the access control of the vehicle 75 is different in the at least one controllable device 36. Specifically, the at least one controllable device 36 of the vehicle 75 includes, but not limited to, a seat, the steering wheel, the car audio equipment, and the air conditioner. When the anti-theft state deactivation step 135 is carried out, the personalized setting of the user correlated to the seat, the steering wheel, the car audio equipment, and the air conditioner is adjusted according to the personal habit. Thus, different users of the vehicle 75 can use the same electronic key 40 or different electronic keys 40 to adjust the at least one controllable device 36 according to the personal habit, which is highly convenient.

Figure 6:
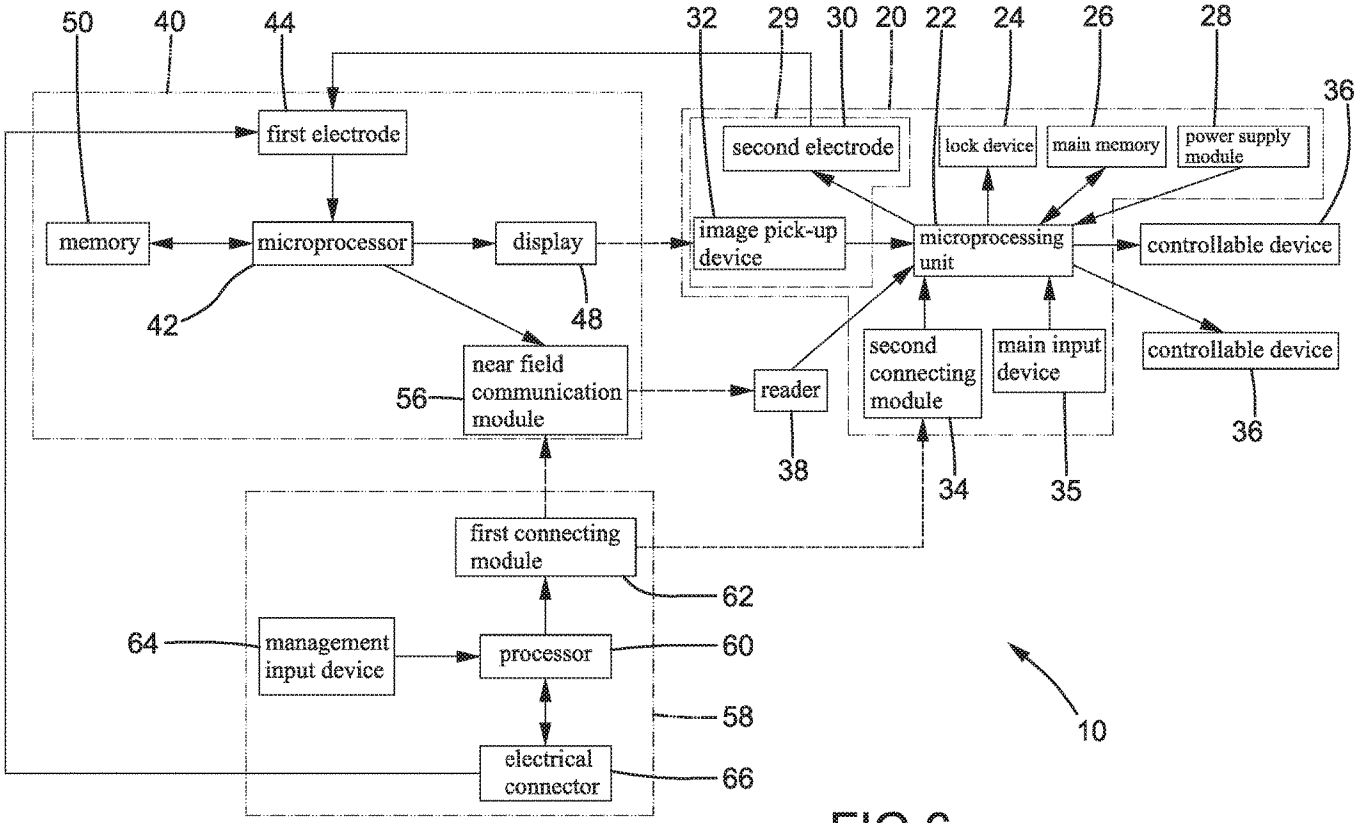
FIG. 6 is a block diagram of an anti-theft control system of a second embodiment according to the present invention.
Figure 7:
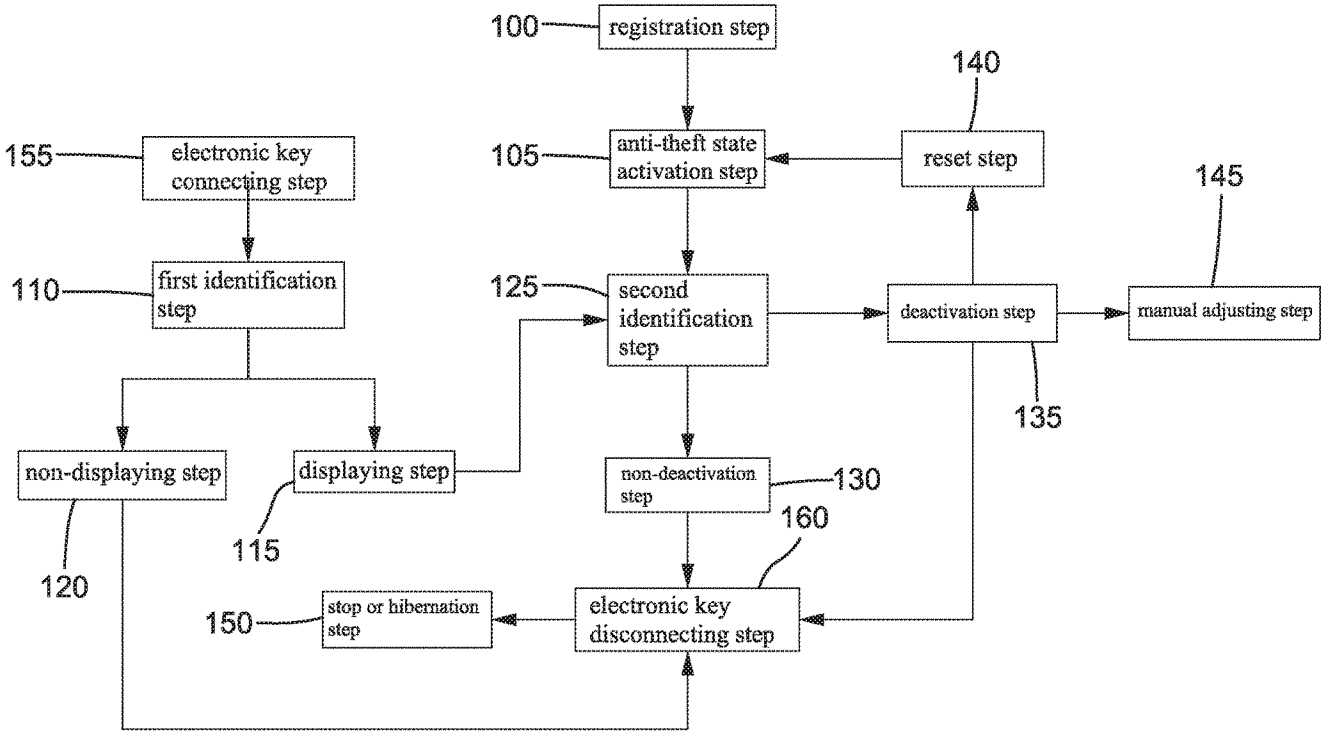
FIG. 7 is a schematic flowchart illustrating an anti-theft control method of the second embodiment according to the present invention.
Figure 8:
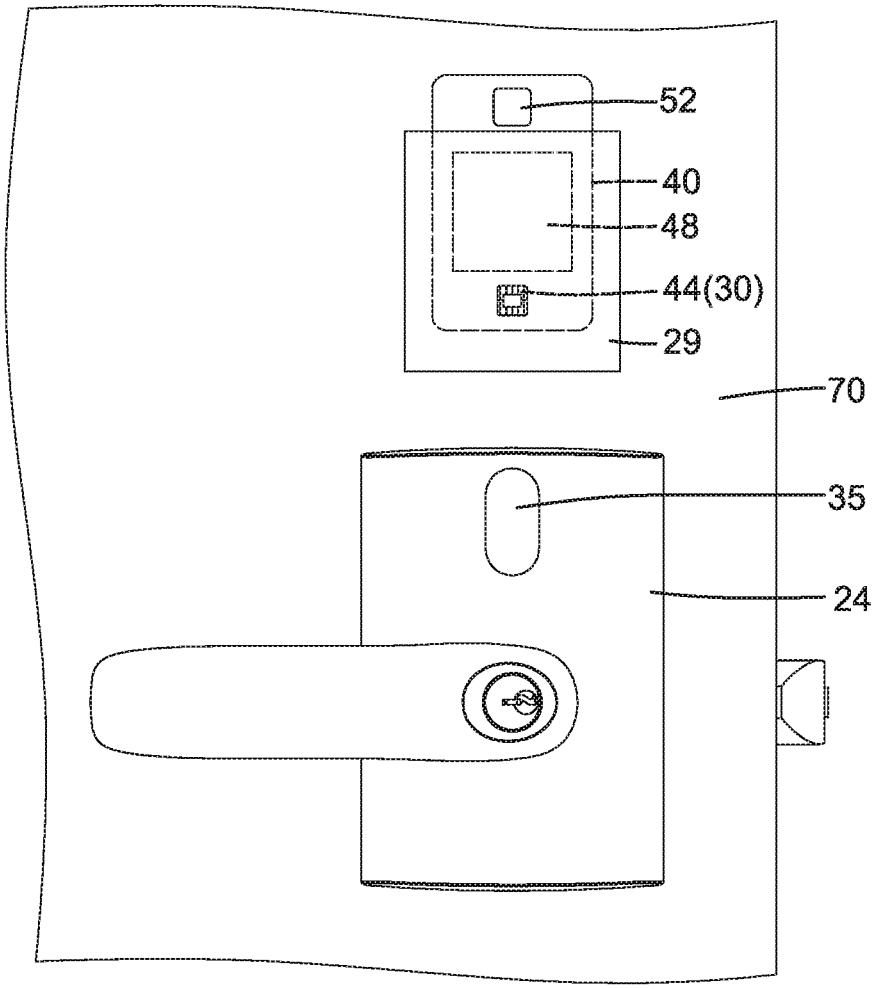
FIG. 8 is a schematic view illustrating use of the anti-theft control system of the second embodiment according to the present invention on a door.

FIGS. 6 and 7 show an anti-theft control system 10 and an anti-theft control method of a second embodiment according to the present invention. To avoid redundancy, only the differences between the first and second embodiments will be described. Specifically, the electronic key 40 does not have to include the power supply unit 46, the anti-theft equipment 20 includes a main input device 35, and the image pick-up device 32 and the second electrode 30 are integrated as a card reading device 29 (FIG. 8).

The registration step 110 of the second embodiment is the same as the registration step 110 of the first embodiment. Furthermore, an electronic key connecting step 155 is carried out before the first identification step 110. In the electronic key connecting step 155, the electronic key 40 is inserted into the card reading device 29 to electrically connect the first electrode 44 of the electronic key 40 with the second electrode 30 of the anti-theft equipment 20. Thus, the power supply module 28 of the anti-theft equipment 20 supplies electricity for operation of the electronic key 40. The display 48 is aligned with the image pick-up device 32. In this case, the display 48 of the electronic key 40 is located inside the card reading device 29 and, thus, cannot be seen (FIG. 8). Furthermore, with the electronic key 40 supplied with electricity, the main input device 35 of the anti-theft equipment 20 can be used to input the instant identification information (such as say "please open the door") for comparison with the identification comparison information of the electronic key 40.

When the inputted instant identification information does not match with any identification comparison information, the display 48 does not show any authentication information (the non-displaying step 120). Thus, the anti-theft equipment 20 cannot read the authentication information and, thus, remains in the anti-theft state, and the lock device 24 remains in the locking state. Then, an electronic key disconnecting step 160 is carried out to disconnect the electronic key 40 from the card reading device 29.

When the inputted instant identification information matches with an identification comparison information, the display 48 shows a corresponding authentication information (the displaying step 115). The anti-theft equipment 20 reads the authentication information on the display 48 and identifies whether the authentication information matches with the anti-theft state releasing identification information (the second identification step 125).

When the authentication information does not match with the anti-theft state releasing identification information, the anti-theft equipment 20 remains in the anti-theft state, and the lock device 24 remains in the locking state. Then, the electronic key disconnecting step 160 is carried out to disconnect the electronic key 40 from the card reading device 29.

When the authentication information matches with the anti-theft state releasing identification information, the anti-theft equipment 20 is set to release the anti-theft state, and the lock device 24 is set to the unlocking state (the anti-theft state deactivation step 135). At the same time, the anti-theft equipment 20 uses the personalized setting correlated to the authentication information to set each controllable device 36 (the anti-theft state deactivation step 135). After completion of the anti-theft state deactivation step 135, the electronic key disconnecting step 160 is carried out to disconnect the electronic key 40 from the card reading device 29. Furthermore, the manual adjustment step 145 can be carried out to manually adjust each controllable device 36. After the electronic key disconnecting step 160, the first electrode 44 of the electronic key 40 is disconnected from the second electrode 30 of the anti-theft equipment 20, such that the display 48 of the electronic key 40 without electricity will not show any authentication information. Furthermore, the anti-theft equipment 20 reenters the anti-theft state, and the lock device 24 is set to the unlocking state (the reset step 140).

Furthermore, after the electronic key disconnecting step 160, the stop or hibernation step 150 can be carried out through the reader 38. Namely, the anti-theft equipment 20 sends a stop signal or a hibernation signal (which is a setting of stop of hibernation) to stop or hibernate all controllable devices 36.

In each embodiment of the anti-theft control system 10 according to the present invention, even if the electronic key 40 is lost, the person picking up the electronic key 40 cannot pass the verification of the first identification step 110 to release the anti-theft state of the anti-theft equipment 20, which is relatively safe in use.

In each embodiment of the anti-theft control system 10 according to the present invention, after pairing the personalized setting and the anti-theft state releasing identification information, the anti-theft equipment 20 can set at least one controllable device 36 according to the specialized setting correlated to a user of an electronic key 40 (no matter there is only one electronic key 40 or a plurality of electronic keys 40). Thus, the at least one controllable device 36 can be set according to the habit of the user while releasing the anti-theft state of the anti-theft equipment 20, which is relatively convenient in use.

The stop or hibernation step 150 in each embodiment permits simultaneous stop or hibernation of a plurality of controllable devices 36, which is relatively convenient when used in a house while saving electrical energy.

In the anti-theft control system 10 of the second embodiment, the display 48 is located inside the card reading device 29 when the electronic key 40 is coupled with the card reading device 29. Thus, when the display 48 shows the authentication information, only the user of the image pick-up device 32 can see the authentication information to effectively avoid leakage of the authentication information, improving the use safety of the electronic key 40.

The electronic key 40 of the second embodiment does not include the power supply unit 46. In a case that the display 48 is an electronic paper, the electronic key 40 can be as thin as a card, which is convenient to carriage while providing high safety.

Now that the basic teachings of the present invention have been explained, many extensions and variations will be obvious to one having ordinary skill in the art. For example, the registration step 100 in each embodiment does not have to include input of the specialized setting. Furthermore, the anti-theft control system 10 and the anti-theft control method of the first embodiment do not have to include the power supply unit 46. In this case, the electronic key 40 can obtain the electricity through electrical connection of the first and second electrodes 44 and 30 (the first and second identification steps 110 and 125) or electrical connection of the first electrode 44 and the electrical connector 66 (the registration step 100) for normal operation of the electronic key 40. Alternatively, the anti-theft equipment 20 of the second embodiment does not have to include the main input device 35. In this case, when the electronic key 40 is connected to the card reading device 29, the input device 52 of the electronic key 40 is located outside of the card reading device 29, such that the input device 52 of the electronic key 40 can be used to input the instant identification information during the first and second identification steps 110 and 125. Furthermore, the identification comparison information and the authentication information do not have to be identical. As an example, the identification comparison information can be the fingerprint of the user, and the authentication information and the anti-theft state releasing identification information can be the vocal pattern of the user. Furthermore, the main memory 26 does not have to be placed in the anti-theft equipment 20. For example, the memory (such as a hard disk) of the management device 58 (such as a computer) can be used to store the anti-theft state releasing identification information. In this case, when the second identification step 125 is carried out, the anti-theft equipment 20 is connected to the management device 58 to read the anti-theft state releasing identification information for comparison with the authentication information read by the image pick-up device 32.

Furthermore, the anti-theft control system 10 and the anti-theft control method according to the present invention can be used in any suitable places and should not be limited to the room 72 or the vehicle 75.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An anti-theft control method comprising:

a registration step including storing an identification comparison information and an authentication information related to a holder of an electronic key in a memory of the electronic key, setting the identification comparison information and the authentication information as a set, and storing an anti-theft state releasing identification information correlated to the authentication information in a main memory of anti-theft equipment;

an anti-theft state activation step including setting a lock device of the anti-theft equipment to a locking state, wherein a display of the electronic key does not show the authentication information when in the anti-theft state;

a first identification step including inputting an instant identification information when it is intended to release the anti-theft state, wherein the instant identification information is compared with the identification comparison information, wherein the anti-theft state is released and the display shows the authentication information when the instant identification information matches with the identification comparison information, and wherein the anti-theft state is retained and the display does not show the authentication information when the instant identification information does not match with the identification comparison information;

a second identification step including reading the authentication information on the display with an image pick-up device of the anti-theft equipment and comparing the authentication information read by the image pick-up device with the anti-theft state releasing identification information, wherein the anti-theft state is not released and the lock device remains in the locking state when the authentication information read by the image pick-up device does not match with the anti-theft state releasing identification information, and wherein the anti-theft state is released and the lock device is set to an unlocking state when the authentication information read by the image pick-up device matches with the anti-theft state releasing identification information;

wherein the registration step further includes storing at least one personalized setting in the main memory, wherein the at least one personalized set value is correlated to a controllable device and the authentication information, wherein the controllable device is adapted to be operated by the holder of the electronic key, wherein when the anti-theft state is being released, the controllable device is set by the at least one personalized setting correlated to the authentication information read by the anti-theft equipment; and wherein a stop or hibernation step after the controllable device is set by the at least one personalized setting, wherein the stop or hibernation step includes connecting the electronic key with a reader and outputting a stop signal or a hibernation signal from the anti-theft equipment to the controllable device to stop or hibernate the controllable device.

2. The anti-theft control method as claimed in claim 1, further comprising a manual adjusting step including manually adjusting at least one operational parameter of the controllable device after the controllable device is set by the at least one personalized setting, wherein the at least one operational parameter is different from the at least one personalized setting.

3. The anti-theft control method as claimed in claim 1, wherein each of the identification comparison information and the authentication information includes at least one of a vocal pattern, a fingerprint, a pin number, a figure, and a biological feature of an iris, a finger vein, or a face.

4. The anti-theft control method as claimed in claim 3, wherein the identification comparison information and the authentication information are identical or different biological features.

5. The anti-theft control method as claimed in claim 1, further comprising a reset step including resetting the anti-theft state after the lock device has been set to the unlocking state and operated and/or manually setting the anti-theft equipment to the anti-theft state.

6. The anti-theft control method as claimed in claim 1, wherein in the first identification step the instant identification information is inputted through an input device of the electronic key, and a microprocessor of the electronic key identifies whether the instant identification information matches with the identification comparison information.

7. The anti-theft control method as claimed in claim 1, the registration step further includes inputting a management authorization information into a management device to obtain a management authority and connecting the management device with one of the electronic key and the anti-theft equipment that has not been set, wherein when the management device is connected to the electronic key, the identification comparison information and the authentication information are inputted through a management input device of the management device and are stored in the memory of the electronic key, and wherein when the management device is connected to the anti-theft equipment, the anti-theft state releasing identification information is inputted through the management input device and is stored in the main memory of the anti-theft equipment.

8. The anti-theft control method as claimed in claim 1, further comprising:

before activating the anti-theft state, electronically connecting the electronic key with the anti-theft equipment and supplying electricity from the anti-theft equipment to the electronic key for operation, wherein when the instant identification information matches with the identification comparison information in the first identification step, the anti-theft state is released, and the display uses the electricity supplied by the anti-theft device to show the authentication information; and disconnecting the electronic key from the anti-theft equipment after the second identification step.

9. The anti-theft control method as claimed in claim 8, wherein in the first identification step the instant identification information is inputted through an input device of the electronic key using the electricity supplied by the anti-theft equipment.

10. The anti-theft control method as claimed in claim 8, wherein in the first identification step the instant identification information is inputted through a main input device of the anti-theft equipment.

11. The anti-theft control method as claimed in claim 8, wherein in the registration step the identification comparison information and the authentication information are inputted through a main input device of the anti-theft equipment while the electronic key is in electrical connection with the anti-theft equipment.

12. The anti-theft control method as claimed in claim 8, wherein the registration step further includes storing at least one personalized setting in the main memory, wherein the at least one personalized set value is correlated to a controllable device and the authentication information, wherein the controllable is adapted to be operated by the holder of the electronic key, wherein when the anti-theft state is being released, the controllable device is set by the at least one personalized setting correlated to the authentication information read by the anti-theft equipment.

13. The anti-theft control method as claimed in claim 12, further comprising a manual adjusting step including manually adjusting at least one operational parameter of the controllable device after the controllable device is set by the at least one personalized setting, wherein the at least one operational parameter is different from the at least one personalized setting.

14. The anti-theft control method as claimed in claim 12, further comprising a stop or hibernation step after the controllable device is set by the at least one personalized setting and after disconnecting the electronic key from the anti-theft equipment, wherein the stop or hibernation step includes connecting the electronic key with a reader and outputting a stop signal or a hibernation signal from the anti-theft equipment to the controllable device to stop or hibernate the controllable device.

15. The anti-theft control method as claimed in claim 8, wherein each of the identification comparison information and the authentication information includes at least one of a vocal pattern, a fingerprint, a pin number, a figure, and a biological feature of an iris, a finger vein, or a face.

16. The anti-theft control method as claimed in claim 15, wherein the identification comparison information and the authentication information are identical or different biological features.

17. The anti-theft control method as claimed in claim 8, further comprising a reset step including resetting the anti-theft state after the lock device has been set to the unlocking state and operated and/or manually setting the anti-theft equipment to the anti-theft state.

18. An anti-theft control method comprising:

storing an identification comparison information and an authentication information in an electronic key;

storing an anti-theft state releasing identification information in anti-theft equipment, wherein the electronic key compares an inputted instant identification information with the identification comparison information, wherein a display of the electronic key shows the authentication information when the instant identification information matches with the identification comparison information;

reading the authentication information on the display with the anti-theft equipment and comparing the authentication information with the anti-theft state releasing identification information, wherein the anti-theft state is released and the lock device is set to an unlocking state when the authentication information read by the anti-theft equipment matches with the anti-theft state releasing identification information, and wherein the anti-theft state is not released and the lock device remains in the locking state when the authentication information read by the anti-theft equipment does not match with the anti-theft state releasing identification information;

storing at least one personalized setting in the anti-theft equipment;

wherein the at least one personalized set value is correlated to a controllable device and the authentication information, wherein the controllable is adapted to be operated by a holder of the electronic key, wherein when the anti-theft state is being released, the controllable device is set by the at least one personalized setting correlated to the identification information read by the anti-theft equipment; and wherein after the controllable device is set by the at least one personalized setting, connecting the electronic key with a reader and outputting a stop signal or a hibernation signal from the anti-theft equipment to the controllable device to stop or hibernate the controllable device.

19. The anti-theft control method as claimed in claim 18, further comprising manually adjusting at least one operational parameter of the controllable device after the controllable device is set by the at least one personalized setting, wherein the at least one operational parameter is different from the at least one personalized setting.

20. The anti-theft control method as claimed in claim 18, wherein each of the identification comparison information and the authentication information includes at least one of a vocal pattern, a fingerprint, a pin number, a figure, and a biological feature of an iris, a finger vein, or a face.

21. The anti-theft control method as claimed in claim 20, wherein the identification comparison information and the authentication information are identical or different biological features.

22. An anti-theft control system comprising:

an electronic key including:

a microprocessor;

a memory electrically connected to the microprocessor, wherein an identification comparison information and an authentication information are stored in the memory;

a display electrically connected to the microprocessor, wherein the display is configured to display the authentication information, wherein the electronic key is configured to be inputted with an instant identification information that is temporarily stored, wherein the display shows the authentication information when the instant identification information matches with the identification comparison information, and wherein the display does not show the authentication information when the instant identification information does not match with the identification comparison information; and anti-theft equipment includes:

a microprocessing unit, a lock device electrically connected to the microprocessing unit, wherein the microprocessing unit is configured to set the lock device to a locking state or an unlocking state, a main memory electrically connected to the microprocessing unit, wherein an anti-theft state releasing identification information is stored in the main memory, an image pick-up device electrically connected to the microprocessing unit, wherein the image pick-up device is configured to read the authentication information displayed on the display, wherein the lock device is set to the unlocking state when the authentication information read by the image pick-up device matches with the anti-theft state releasing identification information, and wherein the lock device is set to the locking state when the authentication information read by the image pick-up device does not match with the anti-theft state releasing identification information;

a controllable device electrically connected to the microprocessing unit, wherein a personalized setting is stored in the main memory and is correlated to the controllable device, wherein when the lock device is set to the unlocking state, the microprocessing unit uses the personalized setting to set the controllable device; and a reader electrically connected to the microprocessing unit of the anti-theft equipment, wherein the reader is configured to read the electronic key, and wherein the microprocessing unit is configured to stop or hibernate the controllable device through a setting of stop of hibernation when the reader is reading the electronic key.

23. The anti-theft control system as claimed in claim 22, wherein the electronic key further includes a first electrode electrically connected to the microprocessor, wherein the anti-theft equipment further includes a power supply module electrically connected to the microprocessing unit and a second electrode electrically connected to the microprocessing unit, wherein when the first electrode is not in electrical connection with the second electrode, the display does not operate, and wherein when the first electrode is in electrical connection with the second electrode, the display is capable of showing the authentication information.

24. The anti-theft control system as claimed in claim 23, wherein the anti-theft equipment further includes a main input device electrically connected to the microprocessing unit, wherein when the first electrode is in electrical connection with the second electrode, the instant identification information is inputted through the main input device.

25. The anti-theft control system as claimed in claim 23, wherein the image pick-up device and the second electrode together form a card reading device, wherein the electronic key is detachably coupled to the card reading device, wherein when the electronic key is coupled with the card reading device, the second electrode is in electrical connection with the first electrode, and the display is located at an inner side of the card reading device and is aligned with the image pick-up device.

26. The anti-theft control system as claimed in claim 22, wherein the electronic key further includes a power supply unit electrically connected to the microprocessor, wherein the power supply unit is configured to supply electricity to the electronic key for operation.

27. The anti-theft control system as claimed in claim 26, wherein the electronic key further includes an input device electrically connected to the microprocessor, wherein the instant identification information is inputted through the input device.

28. The anti-theft control system as claimed in claim 26, further comprising a management device, wherein the management device includes a processor, a first connecting module electrically connected to the processor, and a management input device electrically connected to the processor, wherein the electronic key further includes a near field communication module configured to be electrically connected to the microprocessor, wherein when the near field communication module is electrically connected to the microprocessor, the management input device is configured to permit the identification comparison information and the authentication information to be inputted and stored in the memory of the electronic key.

29. The anti-theft control system as claimed in claim 23, further comprising a management device, wherein the management device includes a processor, an electrical connector electrically connected to the processor, and a management input device electrically connected to the processor, wherein when the first electrode is electrically connected to the electrical connector, the management input device permits the identification comparison information and the authentication information to be inputted and stored in the memory of the electronic key.

30. The anti-theft control system as claimed in claim 22, wherein the display of the electronic key is formed by an electronic paper.

* * * * *